US007351120B1

(12) United States Patent
Gilliland et al.

(10) Patent No.: US 7,351,120 B1
(45) Date of Patent: Apr. 1, 2008

(54) ADJUSTABLE IMPEDANCE ELECTRICAL CONNECTOR

(75) Inventors: Don A. Gilliland, Rochester, MN (US); Dennis J. Wurth, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 11/671,052

(22) Filed: Feb. 5, 2007

(51) Int. Cl.
*H01R 4/28* (2006.01)

(52) U.S. Cl. ..... 439/775

(58) Field of Classification Search ..... 439/66, 439/660, 607–610, 775, 796–798, 801, 810, 439/814; 333/111, 109, 114, 113, 123, 115–116, 333/117, 24 C, 260, 224, 205, 32–35
See application file for complete search history.

(56) References Cited

U.S. PATENT DOCUMENTS 3,359,513 A * 12/1967 Kelley ..... 333/161
4,719,435 A * 1/1988 Maitre ..... 333/224
4,814,780 A * 3/1989 Sterns et al. ..... 343/756
7,064,626 B2 * 6/2006 Kukita et al. ..... 333/24 C

* cited by examiner

*Primary Examiner*—Edwin A. Leon
(74) *Attorney, Agent, or Firm*—Cantor Colburn LLP

(57) ABSTRACT

Disclosed is an adjustable electrical connector. The connector includes a moveable structure including a plurality of return signal conductors disposed on a moveable block, and a fixed structure including a plurality of signal conductors. Each signal return conductor corresponds to and is electrically coupled to one of the plurality of signal conductors. The connector also includes a means for adjusting the electrical coupling of each signal conductor with the corresponding return signal conductor.

5 Claims, 3 Drawing Sheets

ADJUSTABLE IMPEDANCE ELECTRICAL CONNECTOR

TRADEMARKS

IBM® is a registered trademark of International Business Machines Corporation, Armonk, N.Y., U.S.A. Other names used herein may be registered trademarks, trademarks or product names of International Business Machines Corporation or other companies.

BACKGROUND OF THE INVENTION

1. Field of the Invention

This invention relates generally to electronic devices and, more particularly, to an adjustable impedance electrical connector for an electronic device.

2. Description of Background

Ideally, current flows through a electronic device, printed circuit board, or the like, in differential mode, meaning that the current flowing from a particular point along a signal path is equal to the current returning to that point on a return path. Often, though, the current is converted from differential mode to common mode by conditions on the current path. The conversion from differential mode to common mode causes undesirable radiation within the device.

One component of the device that can cause a current mode conversion from differential to common is a connector. The connector often provides a change of impedance as current flows through. This change of impedance causes a voltage drop across the connector, and causes mode conversion from differential to common mode. The mode conversion in the connector in turn produces radiation with in the structure.

What is needed is a connector that does not cause an impedance change across the connector thereby reducing the amount of undesirable radiation within an electronic device.

SUMMARY OF THE INVENTION

The shortcomings of the prior art are overcome and additional advantages are provided through the provision of an adjustable electrical connector. The connector includes a moveable structure including a plurality of signal conductors disposed on a moveable block, and a fixed structure including a plurality of signal return conductors. Each signal return conductor corresponds to and is electrically coupled to one of the plurality of signal conductors. The connector also includes a means for adjusting the electrical coupling of each signal conductor with the corresponding signal return conductor.

Additional features and advantages are realized through the techniques of the present invention. Other embodiments and aspects of the invention are described in detail herein and are considered a part of the claimed invention. For a better understanding of the invention with advantages and features, refer to the description and to the drawings.

TECHNICAL EFFECTS

As a result of the summarized invention, technically we have achieved a solution in which the signal return paths of a connector are adjustable. Adjusting or modifying the signal return paths can eliminate an impedance change and voltage drop across the connector. Eliminating the impedance change and voltage drop reduces undesirable radiation within the connector.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains the preferred embodiments of the invention, together with advantages and features, by way of example with reference to the drawings.

DETAILED DESCRIPTION OF THE INVENTION

Figure 1:
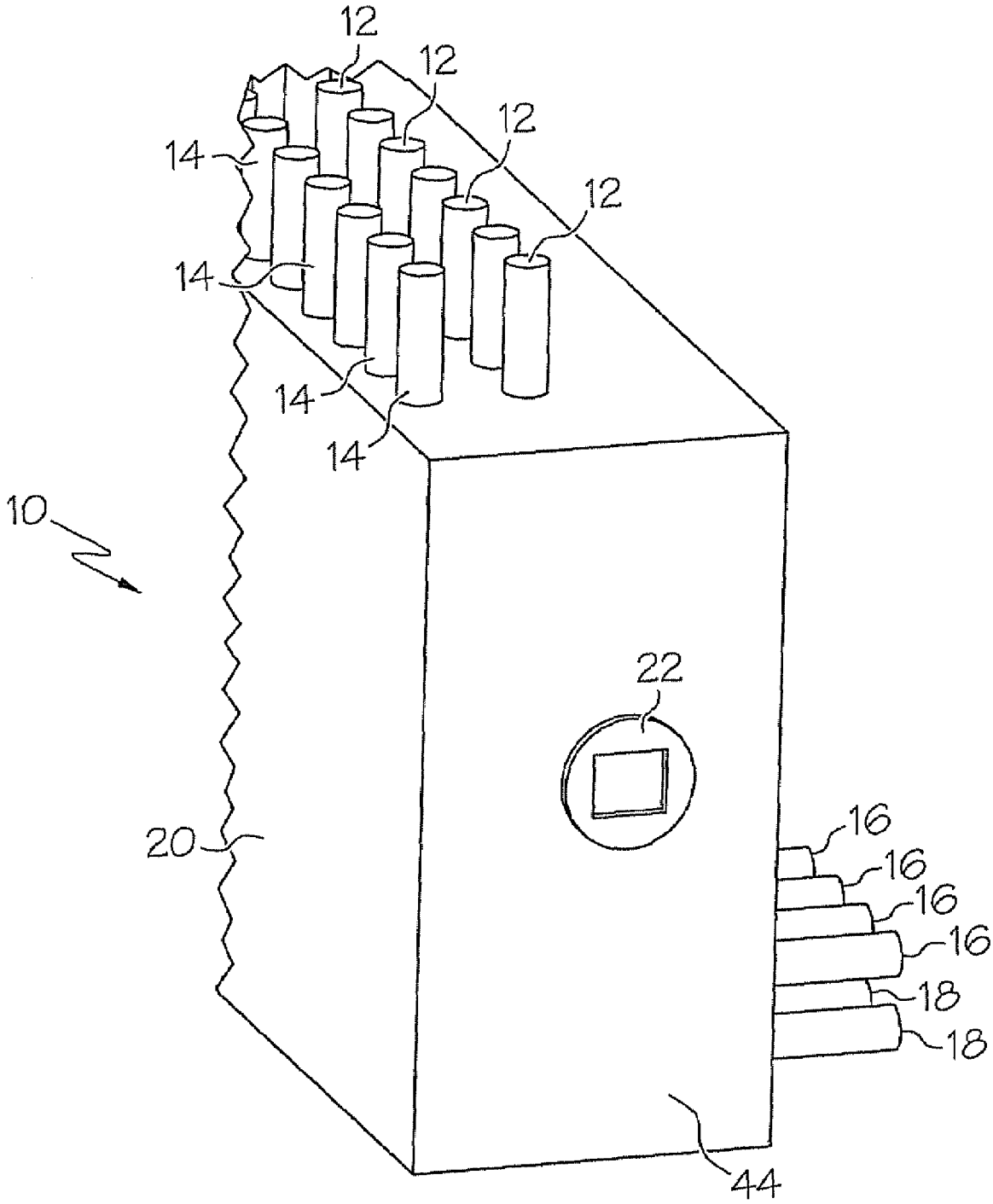
FIG. 1 is a partial perspective view of one example of an adjustable electrical connector.

Turning now to the drawings in greater detail, it will be seen that in FIG. 1 there is an embodiment of an adjustable electrical connector 10. The connector 10 comprises a row of upper return signal conductors 12, a row of upper signal conductors 14, a row of lower return signal conductors 16, and a row of lower signal conductors 18. The conductors 12, 14, 16 and 18 extend through a housing 20 from an interior of the housing 20. The connector 10 further comprises a set screw 22 which extends through the housing 20. In this embodiment, rotating the set screw 22 adjusts the connector 10, as will be explained in more detail below. Other embodiments may include other adjustment mechanisms, such as a gear drive.

Figure 2:
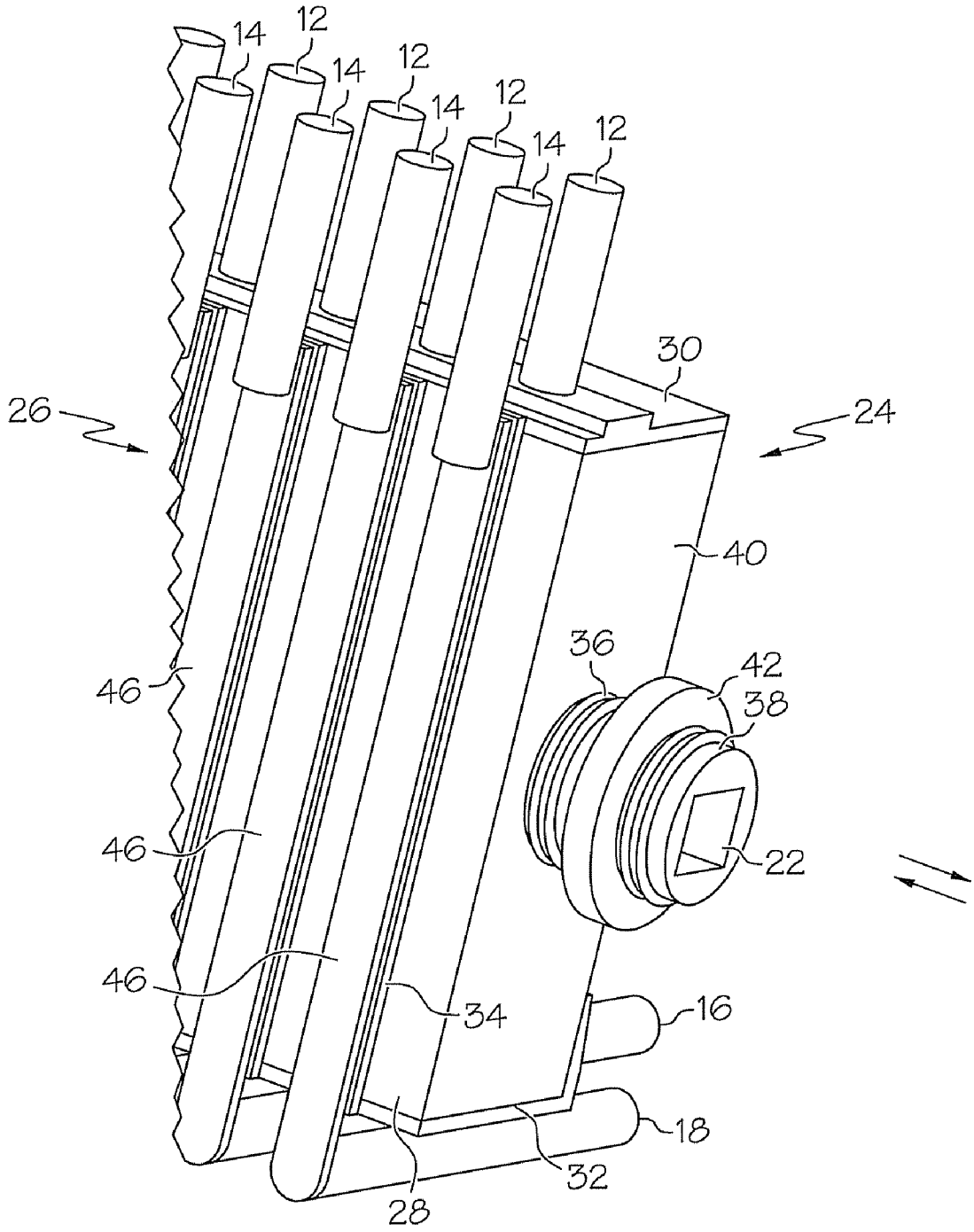
FIG. 2 is a partial perspective view of the connector of FIG. 1, with a housing removed.

In FIG. 2, the connector 10 is illustrated with the housing 20 removed. The interior of the connector includes a moveable structure 24 and a fixed structure 26. The moveable structure 24 includes an internal block 28. The row of upper return signal conductors 12 are mechanically connected to the internal block 28 through an upper plate 30, and the row of lower return signal conductors 16 are mechanically connected to the internal block 28 through a lower plate 32. The upper plate 30 and lower plate 32 are electrically coupled to each other in this embodiment by a plurality of conductive bands 34.

The set screw 22 has a threaded end 36 and a head 38. The threaded end 36 is inserted into a threaded hole (not shown) in an axial end 40 of the internal block 28. A collar 42 is threaded onto the threaded end 36. The collar 42 is captured at an inner surface of the housing 20 such that the collar 42 rotates as the set screw 22 rotates, and such that the head 38 remains substantially flush with the end 44 of the housing 20.

Figure 3:
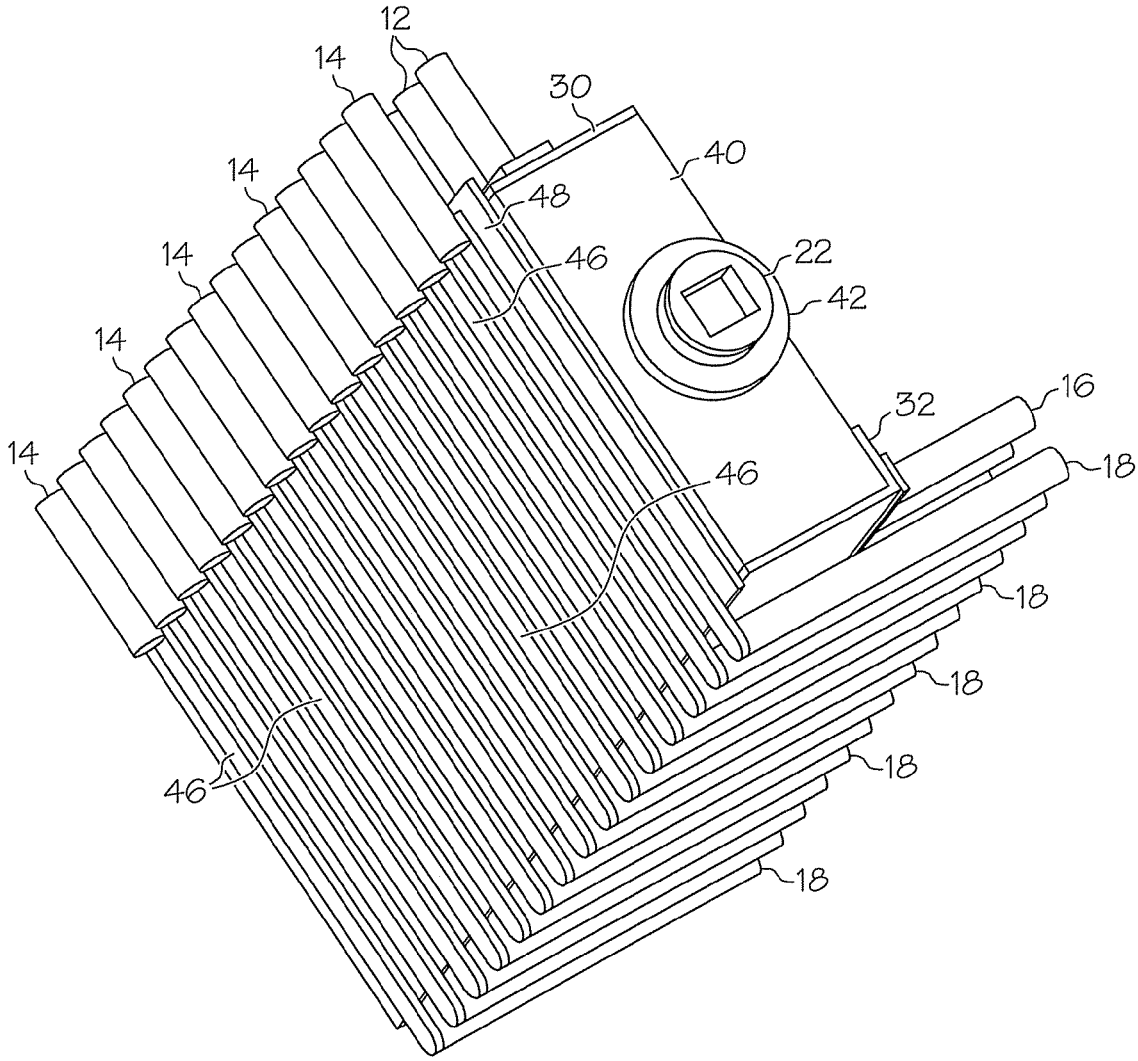
FIG. 3 is a perspective view of the connector of FIG. 1, including a dielectric layer.

The fixed structure 26 includes the row of upper signal conductors 14 and the row of lower signal conductors 18. Each upper signal conductor 14 is attached to a lower signal conductor 18 by a conductive strip 46. Each strip 46 aligns with and substantially overlaps a conductive band 34 of the moveable structure 24, with a clearance between each conductive band 34 and strip 46. The rows of signal conductors 14, 18 extend through the housing 20 and are held fixed in position by the housing 20. In some embodiments, as shown in FIG. 3, a dielectric layer 48 is disposed between the strips 46 and the bands 34. The dielectric layer 48 is included to provide a sufficient increase in capacitance at some frequencies.

The impedance of the connector 10 is adjusted by rotating the set screw 22. Because the set screw 22 is fixed in axial position by the collar 42, as the set screw 42 rotates the moveable structure 24 is moved closer to or farther from the head 38 of the set screw 22. When the set screw 22 is rotated in a clockwise direction as shown in FIG. 2, the movement of the threads of the threaded end 36 relative to the threaded hole in the end 42 of the internal block 28 causes the moveable structure 24 to move closer to the head 38. Alternatively, when the set screw 22 is rotated in a counter clockwise direction as shown in FIG. 2, the moveable structure 24 is caused to move farther from the head 38 of the set screw 22.

The axial movement of the moveable structure 24 relative to the fixed structure 26, changes the amount of overlap of the bands 34 of the moveable structure 24 and the strips 46 of the fixed structure 26. The change in overlap of the bands 34 and the strips 46 alters a return path of the return signal conductors 12, 16. The change in overlap modifies a current path which eliminates an impedance change and resultant voltage drop through the connector 10. Elimination of the voltage drop reduces undesirable radiation within the connector 10.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

What is claimed is:

1. An electrical connector comprising:

a housing;

a moveable structure including a plurality of upper return signal conductors and a plurality of lower return signal conductors disposed on a moveable block, the pluralities of upper signal return conductors and lower signal return conductors including a plurality of conductive strips, with a conductive strip of the plurality of conductive strips corresponding to each return signal conductor;

a fixed structure including a plurality of lower signal conductors and a plurality of upper signal conductors, each signal conductor corresponding to and electrically coupled to one of the plurality of return signal conductors, the pluralities of upper signal conductors and lower signal conductors including a plurality of conductive bands, a conductive band of the plurality of conductive bands corresponding to each signal conductor, the electrical coupling being established by substantially overlapping each conductive band with a corresponding conductive strip; and a set screw having a head captured in the housing and a threaded end inserted in the movable structure, rotating the set screw causing the moveable structure to move longitudinally in relation to the fixed structure thereby adjusting the overlap of each signal conductor with the corresponding return signal conductor and adjusting an electrical coupling of each of signal conductor with the corresponding return signal conductor.

2. An electrical connector comprising:

a housing;

a moveable structure including a plurality of upper return signal conductors and a plurality of lower return signal conductors disposed on a moveable block, the pluralities of upper signal return conductors and lower signal return conductors including a plurality of conductive strips, with a conductive strip of the plurality of conductive strips corresponding to each return signal conductor;

a fixed structure including a plurality of lower signal conductors and a plurality of upper signal conductors, each signal conductor corresponding to and electrically coupled to one of the plurality of return signal conductors, the pluralities of upper signal conductors and lower signal conductors including a plurality of conductive bands, a conductive band of the plurality of conductive bands corresponding to each signal conductor, the electrical coupling being established by substantially overlapping each conductive band with a corresponding conductive strip;

a set screw having a head captured in the housing and a threaded end inserted in the movable structure, rotating the set screw causing the moveable structure to move longitudinally in relation to the fixed structure thereby adjusting the overlap of each signal conductor with the corresponding return signal conductor and adjusting an electrical coupling of each of signal conductor with the corresponding return signal conductor; and a dielectric layer is interspersed between the plurality of conductive bands and the plurality of conductive strips.

3. The electrical connector of claim 2 wherein the set screw is disposed through the housing and installed in a threaded hole in the movable block, rotating the set screw causing the movable structure to move longitudinally in relation to the fixed structure thereby adjusting the electrical coupling of each signal conductor with the corresponding return signal connector.

4. An electrical connector comprising:

a housing;

a moveable structure including a plurality of upper return signal conductors and a plurality of lower return signal conductors disposed on a moveable block;

a fixed structure including a plurality of lower signal conductors and a plurality of upper signal conductors, each signal conductor corresponding to and electrically coupled to one of the plurality of return signal conductors; and a set screw for adjusting an electrical coupling of each signal conductor with the corresponding return signal conductor, the set screw disposed through the housing and installed in a threaded hole in the moveable block, rotating the set screw causing the moveable structure to move longitudinally in relation to the fixed structure thereby adjusting the overlap of each signal conductor with the corresponding return signal conductor and adjusting the electrical coupling of each signal conductor with the corresponding return signal conductor.

5. The electrical connector of claim 4 wherein the plurality of signal conductors includes a plurality of conductive bands, with a conductive band corresponding to each signal conductor, the plurality of return signal conductors includes a plurality of conductive strips, with a conductive strip corresponding to each return signal conductor, the electrical coupling being established by substantially overlapping each band with a corresponding strip.

* * * * *